US005537906A

United States Patent [19]

Steinberger

[11] Patent Number: 5,537,906

[45] Date of Patent: Jul. 23, 1996

[54] STRINGED MUSICAL INSTRUMENT

[76] Inventor: Richard N. Steinberger, 12 Rudy Rd., New Windsor, N.Y. 12553

[21] Appl. No.: 350,811

[22] Filed: Dec. 8, 1994

[51] Int. Cl.[6] ..... G10D 3/00

[52] U.S. Cl. ..... 84/291; 84/293

[58] Field of Search ..... 84/267, 275, 291, 84/292, 293

[56] References Cited

U.S. PATENT DOCUMENTS 5,337,643 8/1994 Cantrell ..... 84/293

*Primary Examiner*—Patrick J. Stanzione

*Attorney, Agent, or Firm*—Saul Epstein

[57] ABSTRACT

An electric stringed musical instrument of the lute family, and in particular, a double bass, wherein the body, neck, and headstock are cut out of a single laminated section of a cone. The front surface of the headstock is coplanar with the neck and body, and the back surface is substantially concentric with the front surface. The strings are anchored in a central cutout in the headstock. Also disclosed is a neck-straightening truss rod capable of exerting either compressive or tensile forces on the neck, a pair of sensors sensitive to string vibrations coupled the bridge which are summed and differenced to provide signals useful in connection with plucked and bowed strings respectively, and a twist resisting support to make a slim double bass practical.

8 Claims, 2 Drawing Sheets

10
11
12
13
14
15
16
17
18
19
20
21
22
23
29
30
31
5

STRINGED MUSICAL INSTRUMENT

BACKGROUND OF THE INVENTION

The present invention is related to stringed musical instruments of the lute family, and more specifically to electrified versions of such instruments. The invention is particularly adaptable to violins, including the contrabass (also called the double bass or upright bass).

A traditional lute family instrument includes an enclosed resonant sound chamber, or body, and a neck, with strings stretched along the neck and over at least a portion of the body. The instruments are played by bowing, strumming, or plucking the strings while clamping them (with the player's fingers) at various points along the neck in order to change the pitches of the resulting tones.

In most cases, the body has no real acoustic function in modern day electrified versions of these instruments, since most, if not all, of the desired sound characteristics can be, and usually are, supplied by the electronic circuitry. However, the structural shapes of the bodies have generally been carried along into electrified versions of the instruments to provide a familiar reference for the player. In the case of the electrified double bass (prior to the present invention), a large body still served a function, i.e., that of preventing the instrument from spinning on its axis when being played. Up until the present invention, a double bass player usually was required to hold the instrument against his or her body to resist the twisting tendency.

The double bass was originally intended primarily to be bowed, and so has a high arch at the bridge to allow selection by the bow of individual strings. A relatively narrow waist on the body is provided in conventional double basses in order to allow bowing of the high and low strings. The bowing position is therefore limited to the waist area.

Conventionally, the back of the neck is convex in shape, which results in a rather thick neck, particularly in instruments which have five or more strings. This neck shape is undesirable from the point of view of ease of playing.

For modern applications of the double bass, as in jazz for example, plucking the strings is more common than bowing. It is therefore important that a modern electric double bass perform well both plucked and bowed. It is also desirable that the bowing position not be limited as it is in traditional double basses.

SUMMARY OF THE INVENTION

The present invention is described in connection with a double bass, but the principles disclosed can be applied to other stringed instruments of the lute family as well. Lute family instruments, including the double bass, are normally considered to have three sections, a body, a neck, and a headstock, with strings stretched between a bridge located on the body, and a nut located between the neck and the headstock. A fingerboard is mounted on the neck, and is spaced from the strings so that the performer can change the effective length of a string by clamping it to the fingerboard with his or her finger.

The body, neck, and headstock of the present invention are cut from a single piece of material which has a conical front surface, and a back surface which is substantially concentric with the front. No resonant sound chamber in the body is included since the invented instrument has electric pickups, and the sound is electronically processed. The conic section which forms the outer surface of the instrument has a base which is a continuous curve, preferably substantially circular. In order to provide a strong structure for the instrument, the material of which the body, neck, and headstock are formed is preferably comprised of alternating laminations of wood and graphite fiber, bonded with resin. The shape of the bridge generally follows the shape of the body, thereby providing a high arch which permits bowing of the strings at any desired location without interference from the body.

The headstock is not angled as in prior art instruments, but is simply a continuation of the neck, with the tuning shafts for the strings extending through the side of the headstock into a central opening. The arched front surface of the headstock causes the tuning shafts for the strings to be sufficiently below the nut as to achieve the necessary down pressure on the null without the necessity of angling.

A unique removable truss rod to adjust the straightness of the neck in the presence of string tension provides either tensile or compressive force, as needed.

Traditional double basses are supported by a single pin extending to the floor from the bottom of the body. The body of the instrument is held against the player to prevent its spinning around the pin. Electric instruments do not require a large body, but are nevertheless commonly fitted with side extensions similar in shape to an acoustic body to help stabilize rotation. The present invention utilizes a rod extending down from the body of the double bass, and a cross bar at the floor to prevent rotation. The rod is pivotally attached to the crossbar in the plane of the crossbar so that the instrument is free to tilt in any direction, but cannot rotate.

The tonal response of a vibrating string held at one end against a fingerboard with a finger is very different for the direction parallel to the fingerboard as compared with vibrations perpendicular to the fingerboard. Vibrations perpendicular to the fingerboard are preferred when the strings are plucked since the fingerboard in this case provides a more rigid end point for the string. Also, the fingerboard restricts excessive travel of the string, for a more even, sustained sound. It is therefore best, in most cases, for the pickup to respond primarily to string motions perpendicular to the fingerboard when the instrument is being plucked.

Bowing, however, excites the strings primarily parallel to the fingerboard, and it is therefore important that the pickup be capable of responding to parallel vibrations. Also, in certain plucked applications, particularly when a more percussive attack is desired, sensitivity to parallel vibrations is desirable.

The present invention includes a pickup with two sensors, one under each outer foot of the bridge, i.e., between each outer foot and the body. By mixing the outputs of these two sensors, after adjustment of their relative phase and amplitude, the relative sensitivity of the instrument to parallel or perpendicular vibrations can be adjusted.

While the foregoing provides a brief synopsis of many of the various features of the invention, a more complete explanation may be had by referring to the attached drawings taken together with the following detailed description of a presently preferred embodiment of the invention.

DETAILED DESCRIPTION OF THE INVENTION

Figures 1, 1A, 1B, 2, 3:
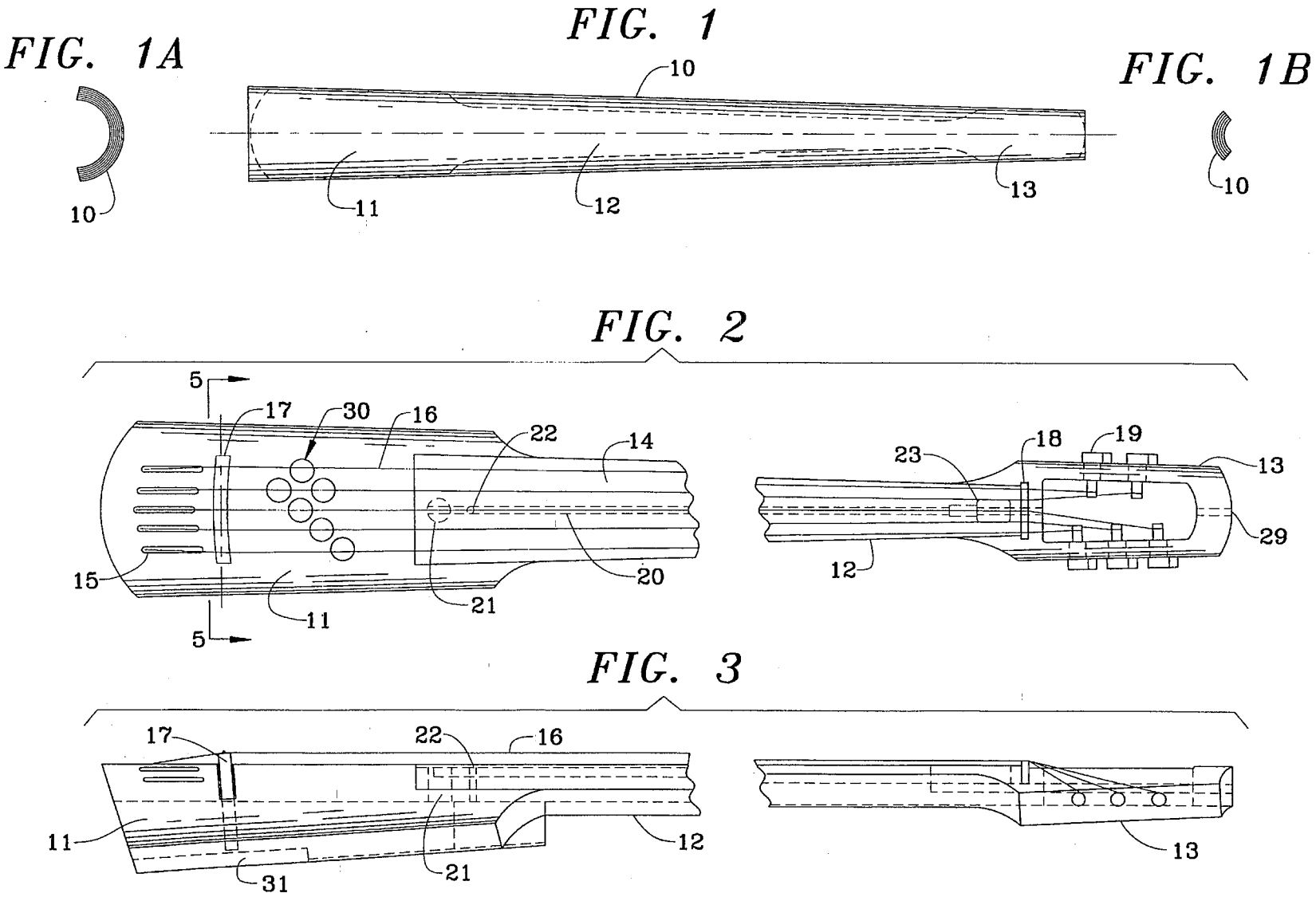
FIG. 1 is a plan view of a blank from which the basic structure of a double bass embodying the principles of the present invention can be cut.
FIG. 1A is an end view of the body end of the blank of FIG. 1.
FIG. 1B is an end view of the headstock end of the blank of FIG. 1.
FIG. 2 is a plan view of a double bass embodying the principles of the present invention.
FIG. 3 is a side view of the double bass illustrated in FIG. 2.

FIGS. 1, 1A, and 1B depict a blank 10 from which the body, neck, and headstock of the invented double bass is cut. The dotted lines in FIG. 1 represent the outline of the finished instrument. The numeral 11 denotes the body, 12 the neck, and 13 the headstock. While other materials could be used in the construction of the instrument, the presently preferred material is a laminated structure including alternate layers of wood veneer and graphite fiber mats, bonded together with resin. The blank is made by forming the layers of wood veneer and graphite fiber mats saturated with resin over a conical form, and then curing the resin. It is preferred that the two outer layers of graphite include continuous fibers of graphite laid lengthwise, to increase the stiffness of the final part. The number of layers in the laminate is not critical, but for purposes of example, a structure including 14 layers of wood veneer interspersed with resin and graphite fibers has been found to result in a satisfactory instrument.

As can be seen from FIGS. 1A and 1B, blank 10 is conical in shape, with the cross sections being continuous curves, preferably arcs of a circle or close thereto. While there are no particular required dimensions for the radii of the blank, as an example, the radius of the outer surface at the body end of the blank could be about three inches, and at the headstock end, about two inches. A thickness of about one inch has been found to be satisfactory. A blank length of 52–53 inches has been found to be adequate to accommodate the strings of a double bass, which are normally about 42 inches in length. The neck portion of the instrument is covered with a fingerboard, which can simply be another lamination of the wood veneer which makes up the blank 10, but preferably, for cosmetic reasons, it is of a material which has a contrasting color. It is also preferable to make the fingerboard from a more abrasion resistant material.

A series of slots 15 (one for each string 16) are cut in the body, and the tail end of the strings anchored by any convenient means at the rear surface of the body behind the slots. The instrument illustrated in the Figures has five strings, but any number desired can be accommodated. Traditional double basses have four strings, but five and six stringed instruments are common. The strings are stretched over bridge 17 located on the body, and nut 18 located between the end of the neck 12 and headstock 13. Tuning machines 19 extending into central opening 20 in the headstock are used to adjust the tension in the strings. The tuning machines may be of conventional design, and the strings tuned in the usual manner.

Because the face of the headstock is (laterally) curved, the location of the tuning machines can be substantially below the level of the nut (as needed to create a sufficient force between the strings and the nut) without slanting or offsetting the headstock, as is done in prior art instruments.

Figure 4:
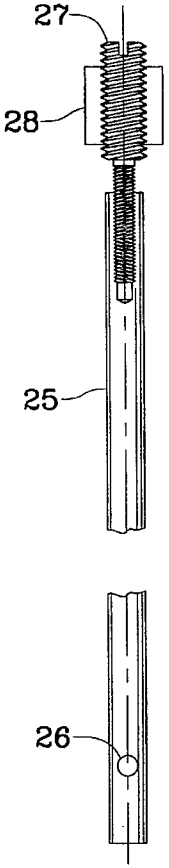
FIG. 4 is a side view of a truss rod for the double bass of FIGS. 2 and 3.

The curved shape of the neck cross section gives it substantially greater stiffness as compared to a conventionally shaped neck of the same bulk. Nevertheless, the strings of a double bass exert a very large force which tends to bend the neck. An adjustable truss rod is preferably provided to adjust the axial curve (relief) of the neck. Most prior art truss rods are capable of exerting compressive forces only (i.e., the rod is in tension), and therefore must be located toward the back of the neck in order to counteract the force exerted by the strings. The truss rod illustrated in FIG. 4 is capable of exerting either tensile or compressive forces, and can therefore be located at the front or back of the neck. The truss rod can increase or decrease relief, as desired. A slot 20 (to provide space for the truss rod) is cut in the neck prior to bonding the fingerboard to the neck. Also, a relatively large hole 21 is drilled through the body at the body end of the slot, as well as a small hole 22 a short distance from the hole 21. At the headstock end of the neck, a recess 23 is sunk into the neck to accommodate a nut (28), which will be described below. The nut (which is rectangular to keep it from rotating) is placed in the recess before the fingerboard is installed.

The truss rod 25 is illustrated in FIG. 4. It is tapped at one end, and has a cross hole 26 near the other end. Adjusting screw 27 and nut 28 can also be seen in FIG. 4. The adjusting screw 27 has two differing pitches, the pitch of the thread going into truss rod 25 being preferably about one half of the pitch of the thread in nut 28. In addition, the minor diameter of the thread in nut 28 is large enough that the truss rod itself (25) can pass through the nut. To install the truss rod, Screw 27 is threaded substantially all the way into the rod, and the assembly inserted into the slot 20 (through hole 29 at the end of the headstock). The screw 27 is then threaded into nut 28 until hole 26 in the truss rod passes hole 22 in the body by one or more diameters. The truss rod is then kept from turning by, for example, a pair of long nose pliers inserted in hole 21, and the screw 27 turned counterclockwise until hole 26 lines up with hole 22. A pin (not shown) is then inserted through hole 22, pinning the truss rod to the body at that point. Turning screw 27 clockwise or counterclockwise, then, causes the truss rod to go into compression or tension, which which increases or decreases the relief in the neck.

A series of magnetic pickups 30 can be seen in FIG. 2 arranged to pick up the vibrations of the strings, as is common in the art. Additionally, there are two sensors (31 and 32), preferably of the piezo-electric type arranged to pick up the vibrations of the bridge 17. These sensors are set between the outer legs (33 and 34) of the bridge and a block 35 which is glued or adjustably fastened to the back surface of the body 11. The bridge has a center section 36 which is connected to the legs 33 and 34 by compliant webs 37 and 38. The section 36 is fastened to block 35 by a screw or other means. The compliant webs 37 and 38 allow the bridge to transfer pressure rotationally about the center section 36 or perpendicular to the block 35. The location of the section 36 is preferably about at the center of the circle formed by the curve of the bridge.

If the outputs of the sensors 31 and 32 are coupled so that their signals are additive, the sum will be most responsive to radial bridge vibrations (i.e., perpendicular to the fingerboard), which is the generally preferred response when plucking the strings. On the other hand, if the sensor outputs are subtractively coupled, the net output will be most responsive to rotational bridge vibrations (i.e., tangential to the bridge curvature), which are the predominant vibrations produced by bowing.

Figure 6:
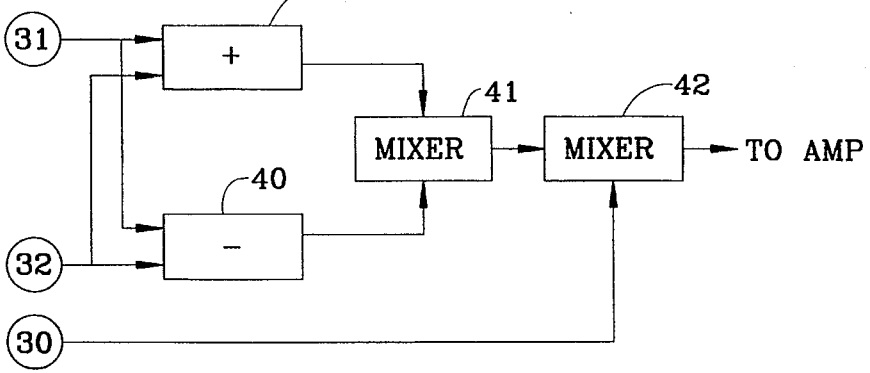
FIG. 6 is a block diagram of the presently preferred mixing circuitry associated with the invented musical instrument.

FIG. 6 is a block diagram of a circuit which provides controls for mixing of the various pickup outputs to achieve the desired sound output. The outputs of sensors 31 and 32 are fed to sum and difference circuits 39 and 40, the outputs of which are fed to mixer 41. In mixer 41, a simple balance control allows any desired proportion of radial and rotational bridge vibrations to be selected and fed to mixer 42 where the output of mixer 41 can be mixed with the outputs of magnetic pickups 30, if desired. Alternatively, mixer 42 can be merely a selector switch which allows the performer to select either the mixed outputs of sensors 31 and 32, or the outputs of magnetic pickups 30.

Figure 7:
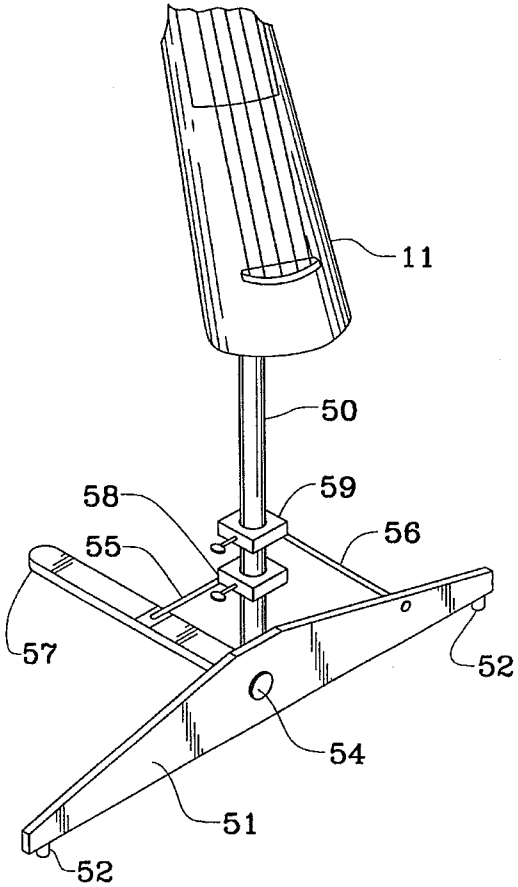
FIG. 7 is a perspective view of a support structure for the double bass of FIGS. 2 and 3, taken from above and to the left of the front of the instument.
Figure 5:
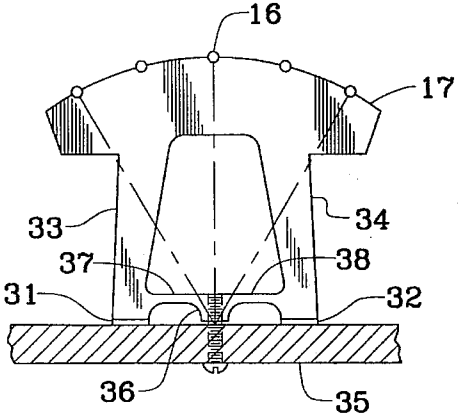
FIG. 5 is a view showing the mounting details of the bridge of the double bass of FIGS. 2 and 3, the view being taken at 5—5 of FIG. 2.

A preferred stand for the invented instrument is illustrated in FIG. 7. A post 50 is fastened to the rear of body 11 by means not shown, and extends downward, preferably at a small angle to the long axis of the instrument, the angle preferably being adjustable. The post 50 may be made telescopic, or other means for length adjustment may be provided, if desired, to adjust the height of the instrument. The free end of post 50 is pivotally attached to a base or cross-bar 51, which has rubber feet 52, and is intended to rest on the floor. The pivot (54) allows the post to pivot in the plane which includes both the post and the cross-bar. Rotation of the instrument is prevented by the cross-bar with its rubber feet, but it can be tilted in any direction with no tendency to spin. The cross-bar can tilt around the line on the floor including rubber feet 52, and the post can tilt in the orthogonal plane around pivot 54.

The instrument can be made self standing by the addition of support bars 55 and 56 which are pivotally attached to a rear leg 57 and the cross-bar, respectively. The rear leg 57 is pivotally attached to the cross-bar 51. Blocks 58 and 59, with thumb screws, allow the post 50 to be secured to the support bars 55 and 56 at any desired height so as to provide a stable three point support for the instrument.

I claim:

1. A stringed musical instrument which comprises:

a body having a face surface which is substantially conical, and a back surface substantially concentric with its face surface;

a neck having a face surface which is substantially conical, and a back surface substantially concentric with its face surface; and a headstock having a face surface which is substantially conical, and a back surface substantially concentric with its face surface;

said body, neck, and headstock being portions of a single piece which has a face surface which is substantially conical, and a back surface which is substantially concentric with its face surface;

a plurality of strings stretched between said headstock and said body;

a nut spacing said strings from said neck at the headstock end whereby each of said strings is substantially equidistant from said neck adjacent said nut; and a bridge spacing said strings from said body whereby each of said strings is substantially equidistant from said body at said bridge.

2. A stringed musical instrument as recited in claim 1 wherein said body, neck, and headstock are cut from a preformed laminated sandwich structure comprised of a plurality of wood veneer layers alternating with graphite fiber layers, molded into a conical shape and bonded with resin.

3. A stringed musical instrument as recited in claim 1 and further including a fingerboard bonded to the face surface of said neck.

4. A stringed musical instrument as recited in claim 1 wherein said headstock is substantially symmetrical with the centerline of said neck, and includes a central cutout, said strings being anchored to said headstock within said central cutout.

5. In a stringed musical instrument of the type including a body, a neck, and a headstock, and including a plurality of strings stretched between said body and said headstock, the improvement which comprises:

said neck and said headstock having face surfaces which are substantially coplanar and curved in the direction orthogonal to the length of said neck, and wherein said strings are anchored to said headstock within a central cutout in said headstock.

6. In a stringed musical instrument as recited in claim 5 wherein said strings are anchored to pegs extending into said central cutout in said headstock from the sides of said headstock.

7. In a stringed musical instrument of the type including a body, a neck, and a headstock, and including a plurality of strings stretched between said body and said headstock, the improvement which comprises a neck having a continuously convex curved front surface and a continuously concave curved back surface substantially parallel to said front surface over its area.

8. In a stringed musical instrument of the type including a body, a neck, and a headstock and a plurality of strings stretched between said body and said headstock, a truss rod for balancing the bending moment on said neck due to tension in said strings which comprises:

an elongated metal rod, threaded at its first end with a first pitch;

means for anchoring the second end of said rod to said musical instrument at one end of said neck;

a threaded nut fastened to said musical instrument at the other end of said neck, the threads of said nut having a second pitch; and a threaded connector having threads of said first pitch and said second pitch connecting said nut and the threaded end of said rod.

* * * * *